United States Patent [19]

Bowden

[11] 4,434,708

[45] Mar. 6, 1984

[54] CONTROL VALVE FOR DOUBLE -ACTING PISTON AND VALVE ASSEMBLIES

[75] Inventor: Charles J. Bowden, Battle Creek, Mich.

[73] Assignee: General Signal Corporation, Stamford, Conn.

[21] Appl. No.: 355,006

[22] Filed: Mar. 5, 1982

[51] Int. Cl.[3] ..... F15B 11/08

[52] U.S. Cl. ..... 91/436; 91/443; 91/454; 91/455; 91/463; 137/494

[58] Field of Search ..... 91/436, 443, 454, 455, 91/463; 137/494

[56] References Cited

U.S. PATENT DOCUMENTS

| | | | |
|---|---|---|---|
| 2,505,527 | 4/1950 | Court | 91/463 |
| 3,006,372 | 10/1961 | Ruhl | 137/622 |
| 3,033,168 | 5/1962 | Ruhl | 121/38 |
| 3,049,101 | 8/1962 | Ruhl | 121/46.5 |
| 3,215,160 | 11/1965 | Rice | 137/596.2 |
| 3,448,685 | 6/1969 | Kroth | 91/436 |
| 3,459,219 | 8/1969 | Genz | 137/596.2 |
| 3,477,347 | 11/1969 | Rice | 91/438 |
| 3,482,600 | 12/1969 | Hodgson | 91/436 |
| 3,568,707 | 3/1971 | Shore | 137/117 |
| 4,132,153 | 1/1979 | Grotness et al. | 91/443 |
| 4,294,278 | 10/1981 | Blake | 137/494 |

FOREIGN PATENT DOCUMENTS

| | | | |
|---|---|---|---|
| 1252492 | 10/1967 | Fed. Rep. of Germany | 91/436 |

*Primary Examiner*—Abraham Hershkovitz
*Assistant Examiner*—Scott L. Moritz
*Attorney, Agent, or Firm*—Thomas R. Fitzgerald; Charles E. Snee, III

[57] ABSTRACT

An improved control valve for double-acting piston and cylinder asemblies is disclosed in which pressure for actuating a regeneration valve to direct hydraulic fluid from the contracting side of the piston to the expanding side, is controlled by a cylindrical check valve apparatus (86–112) which surrounds the valve plunger and controls the pressure of fluid flowing from the contracting side to the reservoir.

17 Claims, 7 Drawing Figures

(NEUTRAL)

(NEUTRAL)

(RAISE)

(LOWER)

(NEUTRAL)

(RAISE)

(LOWER)

CONTROL VALVE FOR DOUBLE -ACTING PISTON AND VALVE ASSEMBLIES

DESCRIPTION

1. Technical Field

The present invention relates to hydraulic valves in which fluid flow is controlled by a selectively positionable plunger or spool. Of special concern are valves having means for routing fluid from the contracting side of an associated double-acting piston and cylinder assembly directly to the expanding side of the assembly, to prevent cavitation on the expanding side when the capacity of the hydraulic pump in the system is insufficient. Such valves are often referred to as regenerative control valves.

2. Background Art

Regenerative control valves and valve systems having similar capabilities have been known for many years. Various types of such valves or systems have been developed but have suffered from certain disadvantages.

For example, hollow plungers have been used in which both load check valves and regeneration valves are located within the plunger, an arrangement which typically requires that one of the load check valves are biased by a rather strong spring to ensure the generation of adequate back pressure to operate the regeneration valve. In such a case the strong spring on the load check valve requires that the associated hydraulic pump operate at higher pressure in order to open the load check valve during normal operation. In other prior art valve systems, a separate regeneration valve has been connected to parallel with the usual control valve to permit flow of fluid from the contracting side to the expanding side of a piston and cylinder assembly. The presence of such a separate regeneration control valve complicates the overall control system and may lead to increased costs.

Thus, a need has continued to exist for a control valve for double-acting piston and cylinder assemblies in which a regeneration capability is provided without the need for a separate regeneration control valve and without the use of heavily loaded check valves which results in increased hydraulic inefficiency.

DISCLOSURE OF THE INVENTION

The primary object of the invention is to provide an improved control valve for use with double-acting piston and cylinder assemblies, the valve including simple, reliable means for minimizing cavitation on the expanding side of such an assembly.

A further object of the invention is to provide such a control valve in which load check valves may be provided with lighter force springs thereby reducing the pumping power required to operate the piston and cylinder assembly.

Yet another object of the invention is to provide such a control valve in which the pressure at which the regeneration valve is actuated is more uniform and less flow sensitive than that of prior art valves of this type.

These objects of the invention are given only by way of example; therefore, other desirable objectives and advantages of the invention may occur or become apparent to those skilled in the art. Nonetheless, the scope of the invention is to be limited only by the appended claims.

The control valve according to the invention is especially adapted for use with double-acting piston and cylinder assemblies and comprises a valve body having a cylindrical bore therein. Several flow chambers communicate with this bore. At least one inlet chamber is provided in the body for receiving fluid from an external supply such as an hydraulic pump and at least one outlet chamber is provided in the body for discharging fluid to an external reservoir or sump. A first cylinder chamber is provided in the body for delivering fluid to and receiving fluid from one side of such a double-acting piston and cylinder assembly; and a second cylinder chamber is provided in the body for delivering fluid to and receiving fluid from the other side of the same piston and cylinder assembly. A valve plunger is positioned in the cylindrical bore and is adapted for sliding movement to control the flow of fluid so as to raise, hold or lower a load associated with the piston and cylinder assembly. Operatively associated with the plunger, the inlet and outlet chambers and the cylinder chambers are means for selectively delivering fluid from the inlet chamber to either one of the cylinder chambers, means for selectively delivering fluid from the other of the cylinder chambers to the outlet chamber and means responsive to a predetermined pressure differential between the cylinder chambers for directing fluid from that one of the cylinder chambers receiving relatively higher pressure from the contracting side of the piston and cylinder assembly to the other cylinder chamber delivering relatively lower pressure fluid to the expanding side of the piston and cylinder assembly. To generate the pressure necessary to actuate the means responsive to a predetermined pressure differential, a pressure responsive valve means is provided in the body which is separate from the spool and which controls the pressure of fluid flowing from the contracting side of the piston and cylinder assembly to the outlet chamber.

In the preferred embodiment of the invention, the pressure responsive valve comprises a thin-walled cylindrical valve guide which surrounds the plunger and comprises at least one passage positioned to permit flow of fluid from the contracting side of the piston and cylinder assembly to the outlet chamber. A thin-walled cylindrical valve element is slidably engaged with the valve guide and means are provided which are responsive to the pressure of fluid from the contracting side of the piston and cylinder assembly to move the valve element relative to the passage in the valve guide so that fluid flows to the outlet chamber.

To move the thin-walled cylindrical valve element, the valve element is provided with a radially inwardly projecting annular piston surface against which acts the pressure of fluid from the contracting side of the piston and cylinder assembly. Means such as a coil spring are provided for biasing the valve element into contact with an adjacent annular valve seat. To provide more uniform actuation pressure for the regeneration valve, the cylindrical valve element preferably is provided with a chamfer on its outer surface adjacent its seating surface. As a result, when the cylindrical valve element moves away from its seat, only a small additional area is exposed to high pressure fluid, thus preventing the valve from opening too rapidly once its lift-off pressure is reached and also ensuring closing of the valve once the pressure drops below the lift-off pressure.

BEST MODE FOR CARRYING OUT THE INVENTION

Figure 1:
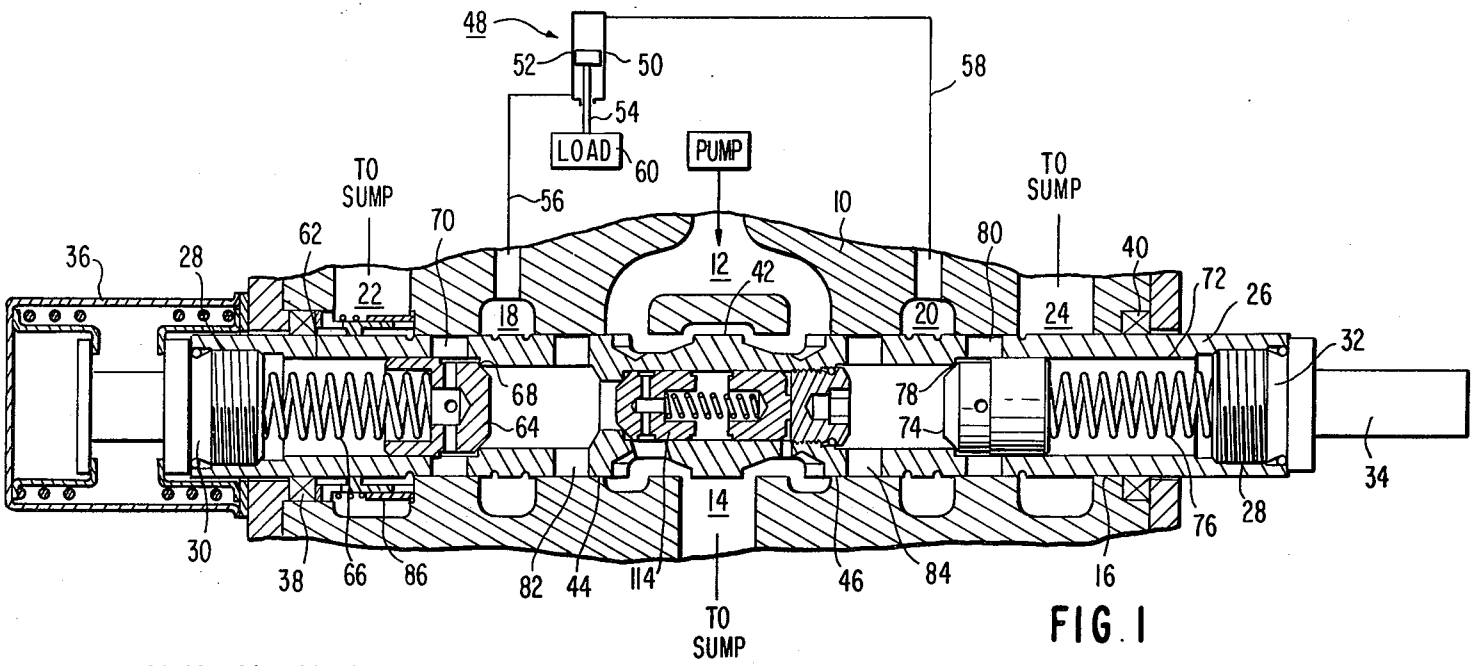
FIG. 1 shows a sectional view of a hollow plunger control valve embodying the invention.

The following is a detailed description of the preferred embodiments of the invention, reference being made to the drawings in which like reference numerals identify like elements of structure in each of the several figures.

FIGS. 1–4 illustrate a preferred embodiment of the invention in which a valve body 10 is provided in the conventional manner with a Y-core inlet chamber for receiving fluid from a source such as an hydraulic pump and a central outlet chamber 14 for delivering fluid to a sump or reservoir. Chambers 12 and 14 both open into a cylindrical bore 16 which extends through body 10 and communicates with a plurality of flow chambers. A first essentially annular cylinder chamber 18 extends around bore 16 to the left of inlet and outlet chambers 12, 14, as illustrated, and a second annular cylinder chamber 20 extends around bore 16 to the right of chambers 12, 14. To the left of cylinder chamber 18, an annular cylinder outlet chamber 22 extends around bore 16. Similarly, to the right of cylinder chamber 20, a second annular cylinder outlet chamber 24 extends around bore 16. Outlet chambers 22, 24 typically are interconnected with central outlet chamber 14 to permit flow to the reservoir, not illustrated.

Within cylindrical bore 16, a plunger 26 is mounted for sliding movement. A through bore 28 in plunger 26 is closed at each end by a pair of threaded caps 30, 32. Cap 32 includes a means 34 for attachment of a suitable valve actuator mechanism in the familiar fashion. Cap 30 cooperates with a conventional double-acting return mechanism 36 which repositions the valve in the neutral position illustrated in FIG. 1 upon release of the valve from its raise or lower positions. A pair of low-pressure seals 38, 40 are captured within valve body 10 in the familiar manner to prevent leakage past plunger 26 to the exterior of the valve assembly.

Plunger 26 comprises a central, circumferential land 42; a left, circumferential land 44; and a right, circumferential land 46, all three of which are closely fitted within bore 16 to provide a more or less leak-free sliding joint. When the valve is positioned as illustrated in FIG. 1, fluid entering chamber 12 from the pump flows through the open center of the valve to outlet chamber 14, while flow along bore 16 is prevented by engagement of lands 44 and 46 with the bore. Cylinder chambers 18 and 20 are in communication with a conventional double-acting piston and cylinder assembly 48 which comprises a cylinder 50, piston 52 and piston rod 54 which extends beyond cylinder 50, as illustrated schematically. The rod end of cylinder 50 is in communication via a pressure line 56 with cylinder chamber 18 and the head end of cylinder 50 is in communication via line 58 with cylinder chamber 20. Because lands 44 and 46 also prevent flow from chambers 18 and 20, the load 60 supported by piston rod 54 is hydraulically locked in position.

Figure 2:
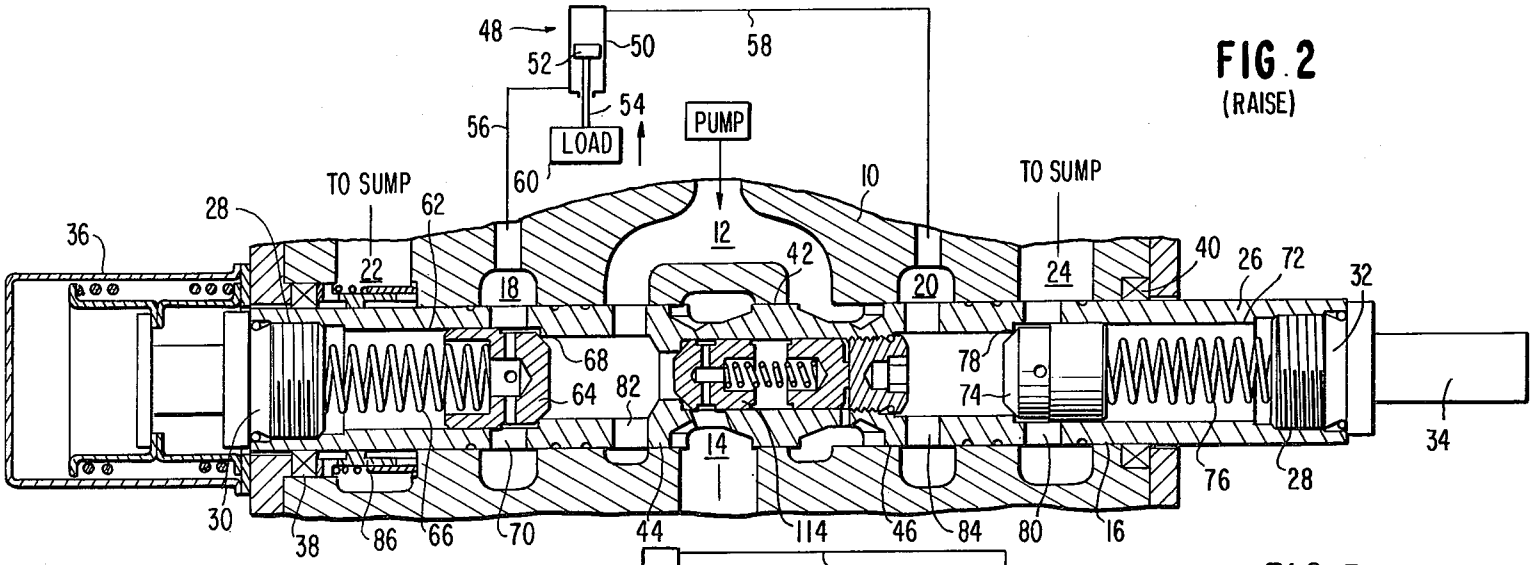
FIG. 2 shows a sectional view of the valve illustrated in FIG. 1 with the plunger positioned for raising a load.

FIG. 2 illustrates the valve of FIG. 1 with plunger 26 shifted to the right in order to raise load 60. Within plunger 26, a left counterbore 62 slidably receives a load check piston 64 which is biased by a spring 66 into contact with an annular valve seat 68 formed at the end of counterbore 62. When the plunger 26 is positioned to raise the load, load check 64 prevents flow of fluid from cylinder chamber 18 into the interior of the plunger through a plurality of radial passages 70 provided through the wall of the plunger 26 in position to communicate with the cylinder chamber. At the right end of plunger 26, a right counterbore 72 receives a load check piston 74 which is baised by a spring 76 into contact with an annular valve seat 78 formed at the end of counterbore 72. When plunger 26 is positioned to raise the load, fluid is allowed to flow from cylinder chamber 20 to outlet chamber 24 through a plurality of radial passages 84 and 80 provided through the wall of the plunger in position to communicate with cylinder chamber 20 and cylinder outlet chamber 24, respectively. In this position, lands 42, 44 and 46 prevent flow of fluid from inlet chamber 12 to outlet chamber 14; however, a plurality of radially extending passages 82 provided through the wall of plunger 26 permit flow from inlet chamber 12 into the interior of plunger 26, past load check 64, through radial passages 70, into annular cylinder chamber 18, through line 56 and into the rod end of cylinder 50 to cause piston 52 and load 60 to move upward, as illustrated in FIG. 2. The pressure at which load check 64 opens is dependent upon the spring constant and degree of compression of spring 66, which may be chosen as needed for a given application. At the same time, fluid leaving cylinder 50 on the contracting side of piston 52 flows through line 58 into annular cylinder chamber 20 and through a plurality of radial passages 84 provived through the wall of plunger 26 in position to communicate with chamber 20 when the plunger is positioned to raise the load. Fluid leaving passages 84 then flows past load check 74, through radial passages 80 and into cylinder outlet chamber 24 from which it returns to the reservoir. The opening pressure of load check 74 also may be varied in the manner previously described for load check 64.

Figure 3:
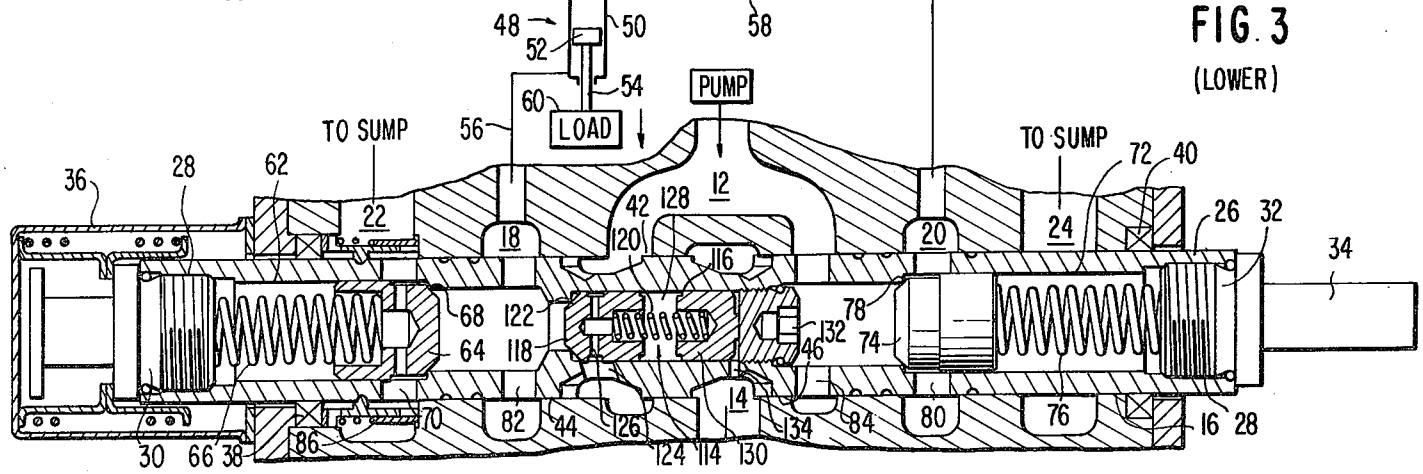
FIG. 3 shows a sectional view of the valve illustrated in FIG. 1 with the plunger positioned for lowering a load.

FIG. 3 illustrates the valve of FIG. 1 when plunger 26 has been moved to the left in order to allow load 60 to drop under the influence of gravity or to be lowered under the control of the pump. In this position, lands 42, 44 and 46 block flow of fluid from inlet chamber 12 to outlet chamber 14; however, radial passages 84 permit flow from inlet chamber 12 into the interior of plunger 26, past load check 74, through radial passages 80, into annular cylinder chamber 20, through line 58 and into the head end of cylinder 50, the volume of which is expanding as the load moves downward. Simultaneously, fluid expelled from the rod end of cylinder 50 passes through line 56, into annular cylinder chamber 18, through radial passages 82, past load check 64 and through radial passages 70 where the fluid encounters a pressure responsive sleeve check valve 86 according to the present invention.

Figure 4:
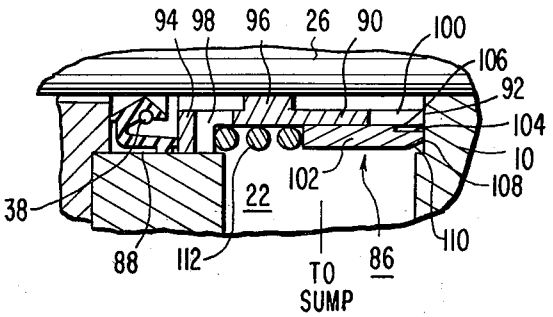
FIG. 4 shows a fragmentary view of the cylindrical check valve embodied in the invention.

An enlarged, fragmentary sectional view of check valve 86 is shown in FIG. 4 as the valve would appear when plunger 26 is in its neutral position. A counterbore 88 is provided in valve body 10 and extends across cylinder outlet chamber 22. A thin-walled cylindrical valve guide 90 is seated on the annular surface 92 of counterbore 88. At its outer end, guide 90 comprises a radially outwardly extending flange 94 which engages the side walls of counterbore 88. Preferably, guide 90 is staked or otherwise secured within counterbore 88 to prevent its outward movement in counterbore 88 into contact with low pressure seal 38, as might occur in response to high pressure fluid acting on the valve guide. A radially inwardly projecting seal land 96 is included on guide 90 to provide a sliding seal between the guide and plunger 26. A plurality of radially extending passages 98 are provided through the wall of guide 90 between flange 94 and land 96 so that any leakage of fluid past land 96 will return to the reservoir via outlet chamber 22. At the end of guide 90 which rests on annular surface 92, a plurality of radially extending flow passages 100 are provided which communicate with radial passages 70 in plunger 26 when the plunger is positioned to lower the load as illustrated in FIG. 3. A thin-walled cylindrical valve element 102 is slidably mounted on the outer diameter of valve guide 90. Although placement of valve element 102 outside of guide 90 is preferred, it is also within the scope of the invention to position the valve element in sliding contact with the inside diameter of guide 90. A counterbore 104 is provided at the seat end of valve element 102 so that an annular piston surface 106 is defined on the inside diameter of the valve element.

The pressure of the fluid reaching valve element 102 through radial ports 70 acts on annular piston surface 106 to open the valve and permit flow through radial passages 100. A narrow annular seating surface 108 is provided on valve element 102 and bears against surface 92 when the valve is in its illustrated, closed position. The radial width and, therefore, the area of surface 108 is held to a minimum by providing a chamfer 110 on the outside diameter of valve element 102. Thus, when end surface 108 moves away from seating surface 92, only a small additional surface is exposed against which the fluid can act to open the valve. This tends to ensure that the valve will open and close reliably at the desired pressure. Finally, a spring 112 is positioned between radial flange 94 and the other end of valve element 102 to bias the valve element into contact with surface 92 and prevent flow through passages 100 until the desired pressure has been generated in passages 70.

Referring again to FIG. 3, it will be seen that fluid passing into the interior of plunger 26 via radial passages 82 also acts on a regeneration control valve 114 positioned at the center of the plunger. A counterbore 116 is provided in plunger 26 for slidably receiving a regeneration check piston 118 which is biased by a spring 120 into contact with an annular valve seat 122 defined at the bottom of counterbore 116. A plurality of radial passages 124 are provided in plunger 26 between lands 42 and 44 in position to communicate with inlet chamber 12 when the valve is positioned to lower the load as illustrated in FIG. 3. Passages 124 also communicate with internal passages 126 provided in check piston 118 and passages 126 lead to a pressure chamber 128 defined between piston 118 and a further piston 130 also slidably mounted within counterbore 116. Spring 120 not only biases check piston 118 into contact with valve seat 122, but also biases piston 130 into contact with a threaded plug 132 which closes the right-hand end of counterbore 116. Finally, a passage 134 extends through the wall of plunger 26 between lands 42 and 46 to communicate with a small pressure chamber on the right side of piston 130 so that this small pressure chamber is maintained at reservoir pressure when the valve is positioned as illustrated in FIG. 3 and at pump pressure when the valve is positioned as illustrated in FIG. 2.

As previously indicated, one purpose of a valve of the type illustrated in FIGS. 1–4 is to prevent cavitation of the fluid in the expanding side of the piston and cylinder assembly. To do this, relatively higher pressure fluid is directed from the contracting side of the piston and cylinder assembly to the relatively lower pressure expanding side, as a supplement to the fluid delivered by the pump. With the valve positioned as illustrated in FIG. 3, downward movement of load 60 raises the pressure acting within plunger 26 via cylinder chamber 18 and radial passages 82 so that check pistons 64 and regeneration check 118 are subjected to an increased pressure. Typically, lightly biased check 64 will open so that the fluid acts upon annular piston surface 106 of valve 86 and causes valve element 102 to move to the left from the position as illustrated in FIG. 4. This permits a flow of fluid through outlet chamber 22 to reservoir. However, because the flow through radial passages 100 is relatively restricted, a significant back pressure develops within plunger 26 which acts on regeneration check 118. If this pressure is higher than the combined force of spring 120 and the pressure acting in chamber 128, then regeneration check 118 will shift to the right from the position illustrated in FIG. 3. Fluid thus flows past regeneration check 118, through passages 124, into inlet chamber 12, through passages 84, past check 74, through passages 80 and annular chamber 20, through line 58 and into the expanding side of piston and cylinder assembly 48. In situations where the capacity of the pump is adequate to maintain relatively high pressure in inlet chamber 12, check 118 will remain closed but check 64 and valve 86 will open to permit flow to reservoir.

Figure 5:
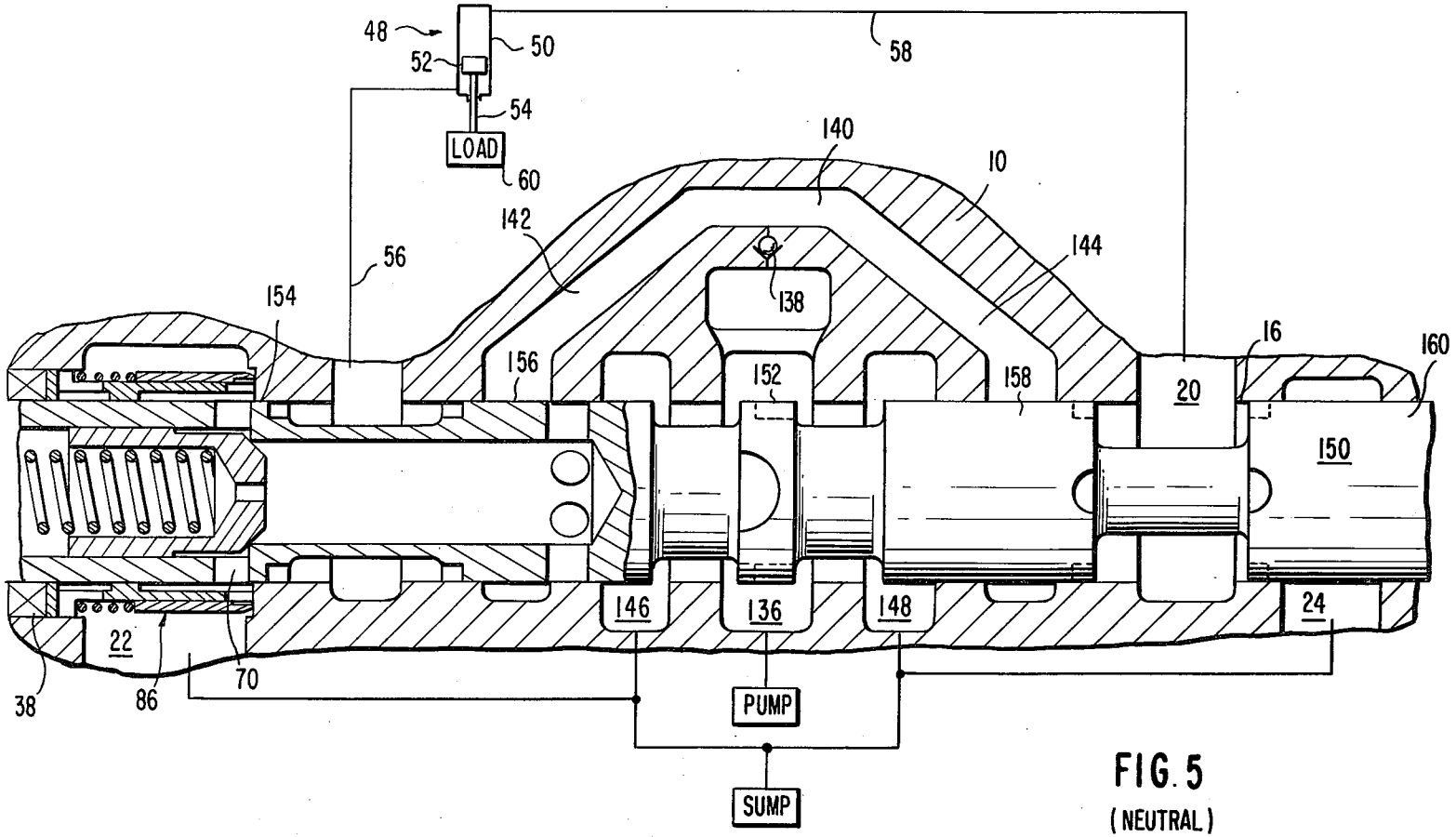
FIG. 5 shows a sectional view of an essentially solid plunger control valve embodying the invention.
Figure 6:
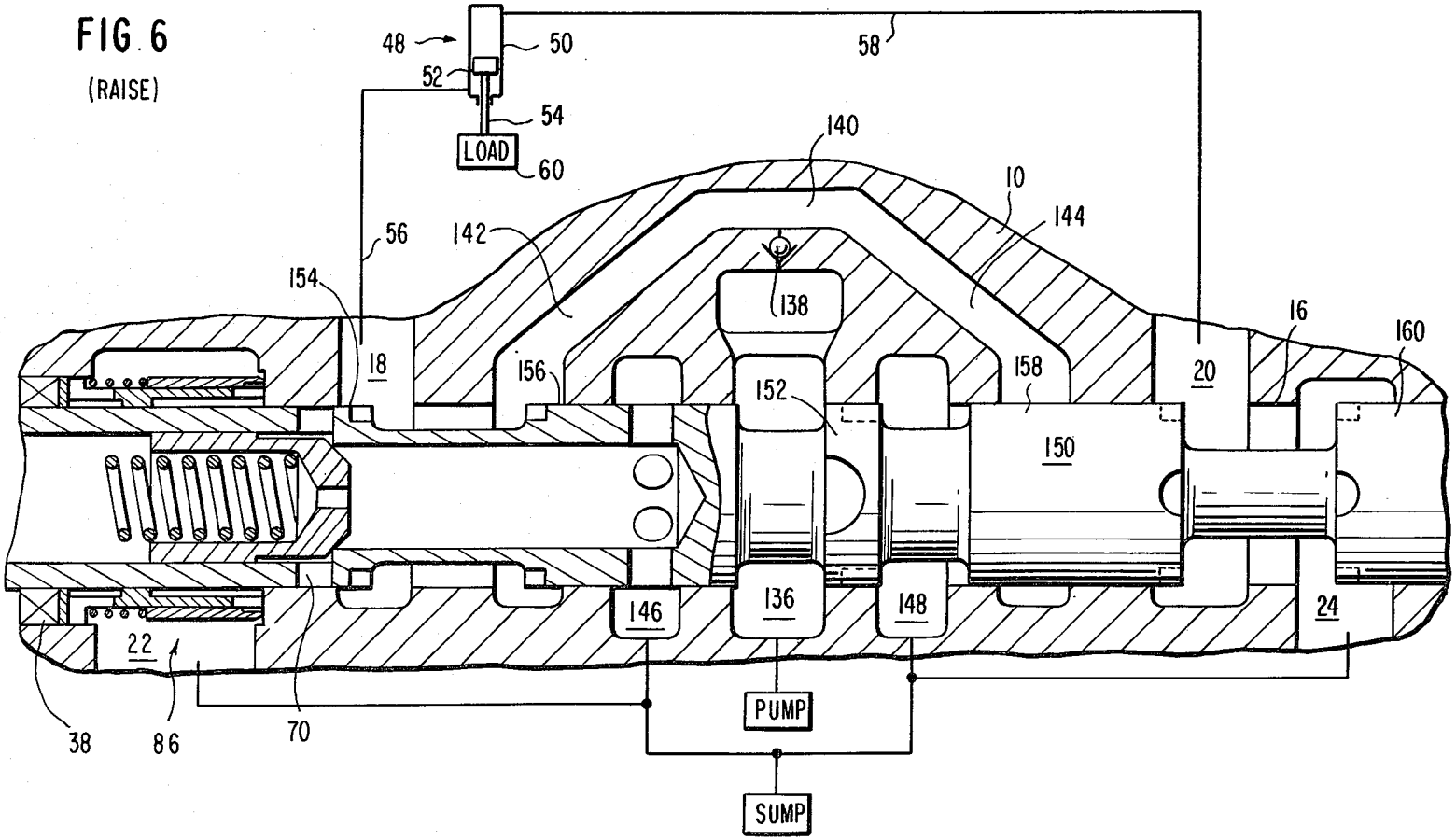
FIG. 6 shows a sectional view of the valve illustrated in FIG. 5 with its plunger positioned to raise a load.
Figure 7:
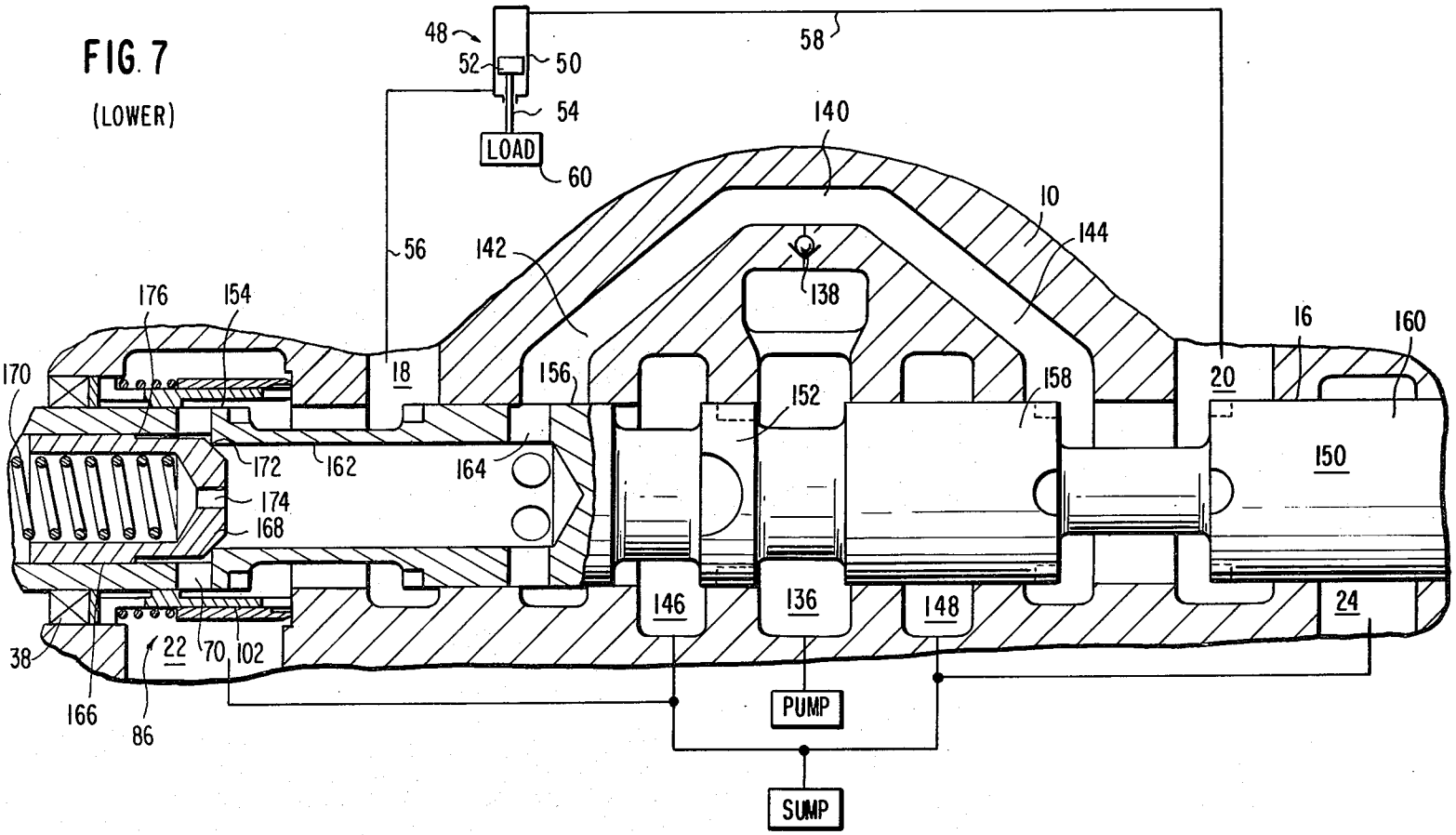
FIG. 7 shows a sectional view of the valve illustrated in FIG. 5 with its plunger positioned to lower a load.

FIGS. 5–7 illustrate another type of control valve which incorporates a pressure responsive sleeve check valve 86 of the type illustrated in FIG. 4. In this embodiment, valve body 10 includes a central inlet chamber 136 which communicates via a load check valve 138 with a branched inlet chamber 140 having a left arm 142 which communicates with bore 16 and a right arm 144 which also communicates with bore 16. A left outlet chamber 146 and a right outlet chamber 148 are positioned on either side of inlet chamber 136. A plunger or spool 150 is mounted for sliding movement in bore 16. A central land 152 on plunger 150 permits flow from inlet chamber 136 to outlet chambers 146, 148 in the neutral position illustrated in FIG. 5. To the left of central land 152, an outer land 154 prevents flow from cylinder chamber 18 into outlet chamber 22 and an inner land 156 prevents flow from inlet chamber 140 into cylinder chamber 18. To the right of central land 152, an inner land 158 prevents flow of fluid from inlet chamber 140 to cylinder chamber 20 and an outer land 160 prevents flow from cylinder chamber 20 to outlet chamber 24. Thus, the flow from the pump goes directly to reservoir and the piston and cylinder assembly 48 is hydraulically locked.

FIG. 6 shows the valve of FIG. 5 with plunger 150 moved to the right to permit raising load 60. In this case, fluid from the pump flows through inlet chamber 136, past check valve 138, into chamber 140, along passage 142, between lands 154 and 156, into cylinder chamber 18, through line 56 and into the rod end of cylinder 50 to raise the load. Simultaneously, fluid having the head end of cylinder 50 passes through line 58, into cylinder chamber 20, between lands 158 and 160 and into outlet chamber 24.

FIG. 7 illustrates the embodiment of FIG. 5 in which plunger 150 has been moved to the left to permit lowering load 60. A blind bore 162 extends into the left end of plunger 150 and intersects a plurality of radial passages 164 which communicate with passage 142 when the plunger is positioned as illustrated. A counterbore 166 at the left end of bore 162 slidably receives a regeneration check valve piston 168 which is biased by a spring 170 into contact with an annular seating surface 172 defined at the end of counterbore 166 just to the right of radial passages 70. As illustrated, valve piston 168 is hollow and includes a flow passage 174 through its right end which allows fluid flowing through passage 142 to act on both sides of valve piston 168. To the left of seating surface 172, piston 168 comprises a reduced diameter portion which defines an outwardly extending radial piston surface 176 which is subject to the pressure of fluid flowing from the contracting side of piston and cylinder assembly 48 via line 56, cylinder chamber 18, the space between lands 154 and 156 and radial passages 70.

As load 60 moves downward, the pressure acting in the head end of cylinder 50 and also within blind bore 162 may drop to such a level that the combined force of spring 170 and the pressure acting on check valve 168 will be exceeded by the force of pressure acting on radially extending piston surface 176. When this happens, check valve 168 moves to the left, thus allowing flow from cylinder chamber 18, through bore 162 and passages 164 into inlet chamber 140, through cylinder chamber 20 and line 58 to the expanding side of cylinder 50, thereby preventing cavitation. Of course, when the capacity of the pump is adequate to maintain ralatively high pressure in bore 162, check valve 168 will remain in its illustrated, closed postion and the flow of fluid from the contracting side of cylinder 50 will hold check valve 102 in its open position, thereby permitting flow to reservoir.

Having described my invention in sufficient detail to enable those skilled in the art to make and use it, I claim:

1. An improved control valve for use with a double-acting piston and cylinder assembly, said valve comprising:

a valve body having a cylindrical bore therein;

at least one inlet chamber in said body with said cylindrical bore for receiving fluid from an external supply;

at least one outlet chamber in said body communicating with said cylindrical bore for discharging fluid to an external reservoir;

a first cylinder chamber in said body communicating with said cylindrical bore for delivering fluid to and receiving fluid from one side of an external double-acting piston and cylinder assembly;

a second cylinder chamber in said body communicating with said cylindrical bore for delivering fluid to and receiving fluid from the other side of the same external double-acting piston and cylinder assembly;

a valve plunger positioned to slide within said bore, said plunger comprising in operative association with said inlet and outlet chambers and with said first and second cylinder chambers, first means for selectively delivering fluid from said inlet chamber to one of said first and second cylinder chambers, second means for selectively delivering fluid from the other of said first and second cylinder chambers to said outlet chamber and third means responsive to a predetermined pressure differential between said first and second cylinder chambers for directing fluid from the one of said cylinder chambers receiving high pressure fluid from the contracting side of the double-acting piston and cylinder assembly, to the other of said cylinder chambers delivering relatively lower pressure fluid to the expanding side of the double-acting piston and cylinder assembly; and pressure responsive valve means connected in series with said second means for controlling the pressure of fluid flowing from the contracting side of the double-acting piston and cylinder assembly, via said second means, to said at least one outlet chamber.

2. A valve according to claim 1, wherein said pressure responsive valve means comprises a valve guide means surrounding said plunger and comprising at least one passage positioned for allowing flow of fluid from said second means to said outlet chamber, a cylindrical valve element slidably engaging said valve guide means, means responsive to the pressure of fluid from the contracting side of the double-acting piston and cylinder assembly for moving said valve element relative to said at least one passage to allow said fluid to flow through said passage to said outlet chamber; and an annular valve seat for engaging said valve element.

3. A valve according to claim 2, wherein said means for moving comprises a radially inwardly projecting annular piston surface on said cylindrical valve element.

4. A valve according to claim 2, further comprising spring means for biasing said valve element into contact with said valve seat.

5. A valve according to claim 2, further comprising a seal surrounding said plunger, wherein said means surrounding said plunger comprises a thin-walled cylindrical valve guide having radially inwardly projecting land which seals against said plunger to prevent overpressurization of said seal.

6. A valve according to claim 5, further comprising at least one further passage through said valve guide between said inwardly projecting land and said seal means to permit leakage past said land to return to reservoir.

7. A valve according to claim 5, wherein said cylindrical valve element, is slidably mounted on the exterior of said valve guide, further comprising spring means for biasing said valve element into contact with said valve seat.

8. A valve according to claim 2, wherein said valve element is circumferentially chamfered at its end which engages said valve seat.

9. A valve according to claim 8, wherein said valve element is chamfered on its outside surface.

10. An improved control valve for use with a double-acting piston and cylinder assembly, said valve comprising:

a valve body having a cylindrical bore therein;

at least one inlet chamber in said body with said cylindrical bore for receiving fluid from an external supply;

at least one outlet chamber in said body communicating with said cylindrical bore for discharging fluid to an external reservoir;

a first cylinder chamber in said body communicating with said cylindrical bore for delivering fluid to and receiving fluid from one side of an external double-acting piston and cylinder assembly;

a second cylinder chamber in said body communicating with said cylindrical bore for delivering fluid to and receiving fluid from one side of an external double-acting piston and cylinder assembly;

a valve plunger positioned to slide within said bore, said plunger comprising in operative association with said inlet and outlet chambers and with said first and second cylinder chambers, first means for selectively delivering fluid from said inlet chamber to one of said first and second cylinder chambers, second means for selectively delivering fluid from the other of said first and second cylinder chambers to said outlet chamber and third means responsive to a predetermined pressure differential between said first and second cylinder chambers for directing fluid from the one of said cylinder chambers receiving high pressure fluid from the contracting side of the double-acting piston and cylinder assembly, to the other of said cylinder chambers delivering relatively lower pressure fluid to the expanding side of the double-acting piston and cylinder assembly; and pressure responsive valve means separate from said plunger for controlling the pressure of fluid flowing from the contracting side of the double-acting piston and cylinder assembly, via said second means, to said at least one outlet chamber, said pressure responsive valve means comprising valve guide means surrounding said plunger and comprising at least one passage positioned for allowing flow of fluid from said second means to said outlet chamber, a cylindrical valve element slidably engaging said valve guide means, means responsive to the pressure of fluid from the contracting side of the double-acting piston and cylindrical assembly for moving said valve element relative to said at least one passage to allow said fluid to flow through said passage to said outlet chamber; and an annular valve seat for engaging said valve element.

11. A valve according to claim 10, wherein said means for moving comprises a radially inwardly projecting annular piston surface on said cylindrical valve element.

12. A valve according to claim 10, further comprising spring means for biasing said valve element into contact with said valve seat.

13. A valve according to claim 10, further comprising a seal surrounding said plunger, wherein said means surrounding said plunger comprises a thin-walled cylindrical valve guide having radially inwardly projecting land which seals against said plunger to prevent overpressurization of said seal.

14. A valve according to claim 13, further comprising at least one further passage through said valve guide between said inwardly projecting land and said seal means to permit leakage past said land to return to reservoir.

15. A valve according to claim 13, wherein said cylindrical valve element is slidably mounted on the exterior of said valve guide, further comprising spring means for biasing said valve element into contact with said valve seat.

16. A valve according to claim 10, wherein said valve element is circumferentially chamfered at its end which engages said valve seat.

17. A valve according to claim 16, wherein said valve element is chamfered on its outside surface.

* * * * *